US007025197B2

(12) United States Patent
Sutherland

(10) Patent No.: US 7,025,197 B2
(45) Date of Patent: Apr. 11, 2006

(54) WRAP AROUND CARRIER FOR PETALOID PET BOTTLES

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/985,331

(22) Filed: Nov. 9, 2004

(65) Prior Publication Data

US 2005/0109641 A1 May 26, 2005

Related U.S. Application Data

(63) Continuation of application No. 10/268,826, filed on Oct. 10, 2002, now Pat. No. 6,814,228.

(51) Int. Cl.
*B65D 75/00* (2006.01)
*A45C 11/00* (2006.01)

(52) U.S. Cl. ..... 206/140; 206/434

(58) Field of Classification Search ..... 206/139, 206/140, 147, 152, 158, 193, 194, 197, 199, 206/427, 434

See application file for complete search history.

(56) References Cited

U.S. PATENT DOCUMENTS

| | | | | |
|---|---|---|---|---|
| 4,533,047 | A * | 8/1985 | Calvert | 206/434 |
| 4,545,485 | A * | 10/1985 | Oliff | 206/434 |
| 4,609,143 | A | 9/1986 | Collura et al. | |
| 5,443,203 | A | 8/1995 | Sutherland | |
| 5,520,283 | A * | 5/1996 | Sutherland | 206/434 |
| 5,524,756 | A * | 6/1996 | Sutherland | 206/434 |
| 5,595,299 | A * | 1/1997 | Le Bras | 206/434 |
| 5,765,685 | A | 6/1998 | Roosa | |
| 6,527,108 | B1 * | 3/2003 | Blin et al. | 206/434 |

* cited by examiner

*Primary Examiner*—Luan K. Bui
(74) *Attorney, Agent, or Firm*—Womble Carlyle Sandridge & Rice, PLLC

(57) ABSTRACT

A wrap around carrier for carrying bottle with a petaloid base having heel assemblies that have hinge doors with a vertical cut line in the bottom of each hinge with a horizontal cut line at the top of each cut line that extends inwardly towards the heel aperture formed by the door. This carton has a second cut line that is either at the bottom of the vertical cut line in each hinge or near the center of the door. None of these cut lines extend into the heel aperture. This combination of cut lines facilitates the control tearing of the cut line at the top of the vertical cut line into the heel aperture.

36 Claims, 4 Drawing Sheets

WRAP AROUND CARRIER FOR PETALOID PET BOTTLES

This application is a continuation U.S. application Ser. No. 10/268,826, filed Oct. 10, 2002, now U.S. Pat. No. 6,814,228.

FIELD OF THE INVENTION

This invention relates to the provision of C or J cuts in the bottom portion of the hinges of the doors of a heel retaining assembly for use with petaloid PET bottles to facilitate the tightening of the locked carrier whether or not a toe on the petaloid bottle is in alignment with the heel aperture formed by the doors or not.

BACKGROUND OF THE INVENTION

1. Prior Art

When fabricating a carrier from a paperboard blank, opposite ends of the blank are conventionally attached to each other by glue or by mechanical locks to form the bottom panel of the carrier. In the case of a wrap around carrier, flaps located on the ends of the blank typically are overlapped and engaged with one another by mechanical locks formed in the flaps to form the bottom panel of the carrier. Since the bottom panel must maintain its integrity throughout the use of the carrier, it is essential that the locking system be capable of supporting the weight of the packaged articles, and remain engaged during shipping and handling of the constructed carrier.

One approach to provide a stable mechanical lock assembly utilizes both primary and secondary locks. An example of such locking system is disclosed in U.S. Pat. No. 5,443,203 to Sutherland.

Bottles constructed out of PET that have petaloid bases are difficult to package in a wrap around carrier that produces a tight package. These petaloid bottles have from four to six toes so the wrap usually has a pair of heel doors to form a heel retaining assembly which allows one of the toes to project through the aperture formed by opening the heel doors. This system works fine if the toe is centered in the aperture formed by opening the heel doors. It is difficult to align the petaloid bottles so that a toe is centered in this aperture. If the toe is not centered it may tear open the heel retaining assembly resulting in a loose wrap around carrier.

SUMMARY OF THE INVENTION

It is an object of the present invention to provide a wrap around carrier with a locking system that can be tightened to produce a tight wrap regardless if a toe of the petaloid bottle being contained is in alignment with the aperture in the heel retaining assembly or not.

The object of this invention is achieved by providing a heel retaining assembly for each petaloid bottle being contained that has two heel doors that have a door hinge for each door that either have a C or upside down J type cut near the bottom of the assembly. If a toe of the petaloid bottle is properly aligned with the aperture formed by opening the doors of the heel retaining assembly the C or upside down J cut does not tear open. However, if a toe of the petaloid bottle is not properly aligned with the aperture of the heel retaining assembly the C or upside down J cut may tear in the direction of the aperture to allow the toe to project into the side of the assembly where it is being torn to a sufficient extent to permit the carrier to be tightened. The C cut is formed at the bottom of each door hinge with the open part of the C projecting toward the aperture formed by the heel doors. A small tear slit may be necessary between the top of the C and the aperture to facilitate the controlled tearing. This slit does not connect with either the top of the C cut or the heel aperture. The upside down J cut is formed at the bottom of the hinge for each heel door with the top of the J being near the bottom of the hinge and the bottom of the J facing the aperture. With the upset down J cut it may be necessary to have slits near the center of each hinge door to facilitate the controlled tearing of the upside down J cut that does not extend to either the heel aperture or hinge.

DETAILED DESCRIPTION OF THE PREFERRED EMBODIMENTS

The present invention is intended primarily for use with wrap around carrier for containing bottles made of polyethylene terephthalate (PET) used to contain soft drinks and the like which has a petaloid base. The PET bottle with the petaloid base typically has from 4 to 6 toes or projections in the base. A typical example of such a bottle having the petaloid base with a generally cylindrical body with an upper portion, a tapering shoulder smoothly continuous with the upper portion of the body, and a neck formed on the shoulder having a smaller diameter than the body. The conventional petaloid PET bottle B also has a neck flange projecting outwardly from the neck, and a cap attached to the upper end of the neck flange.

Figure 1A:
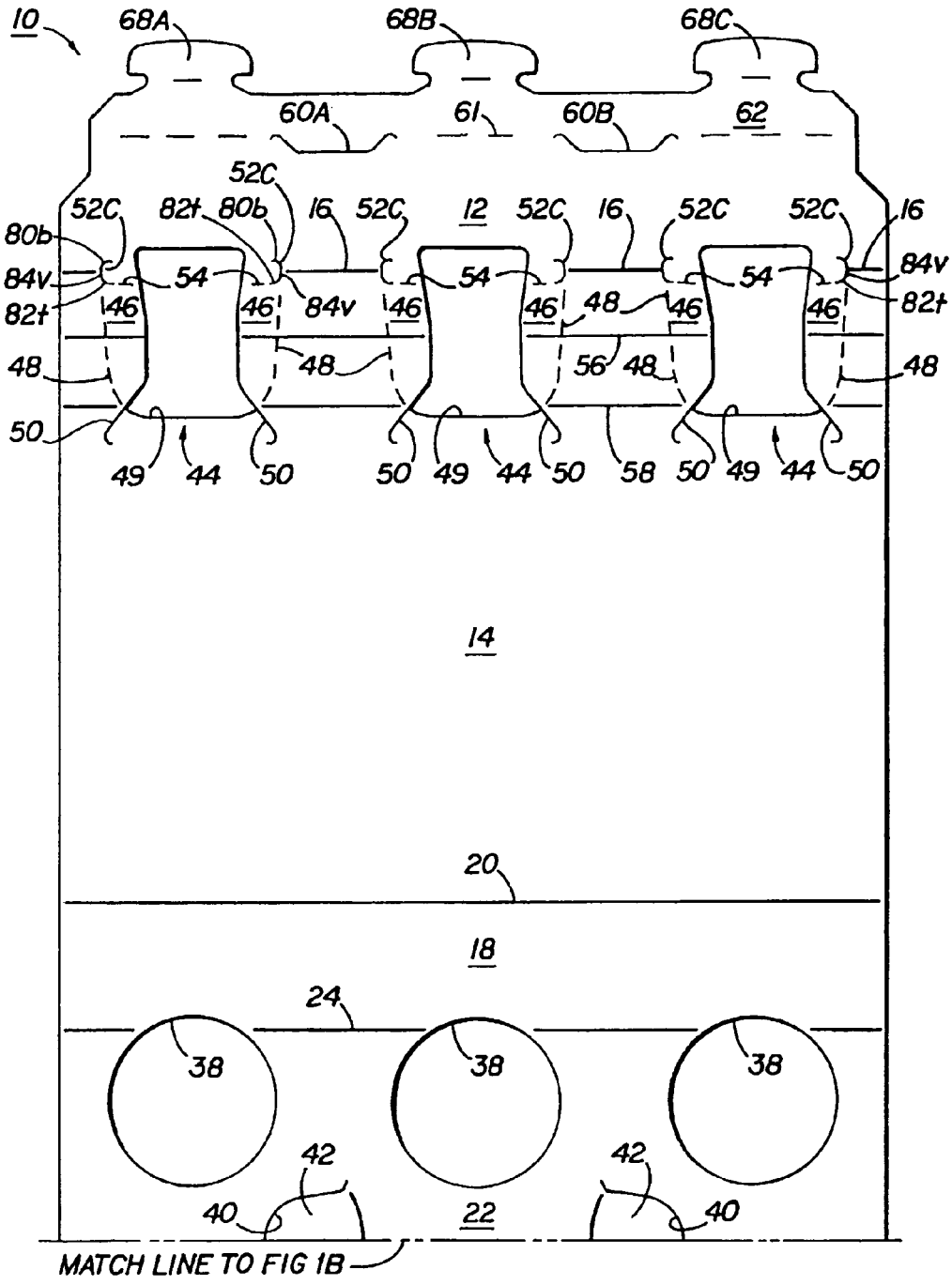
FIGS. 1A and 1B are a plan view of a blank which incorporates the C cut in each door hinge of the present invention.
Figure 1B:
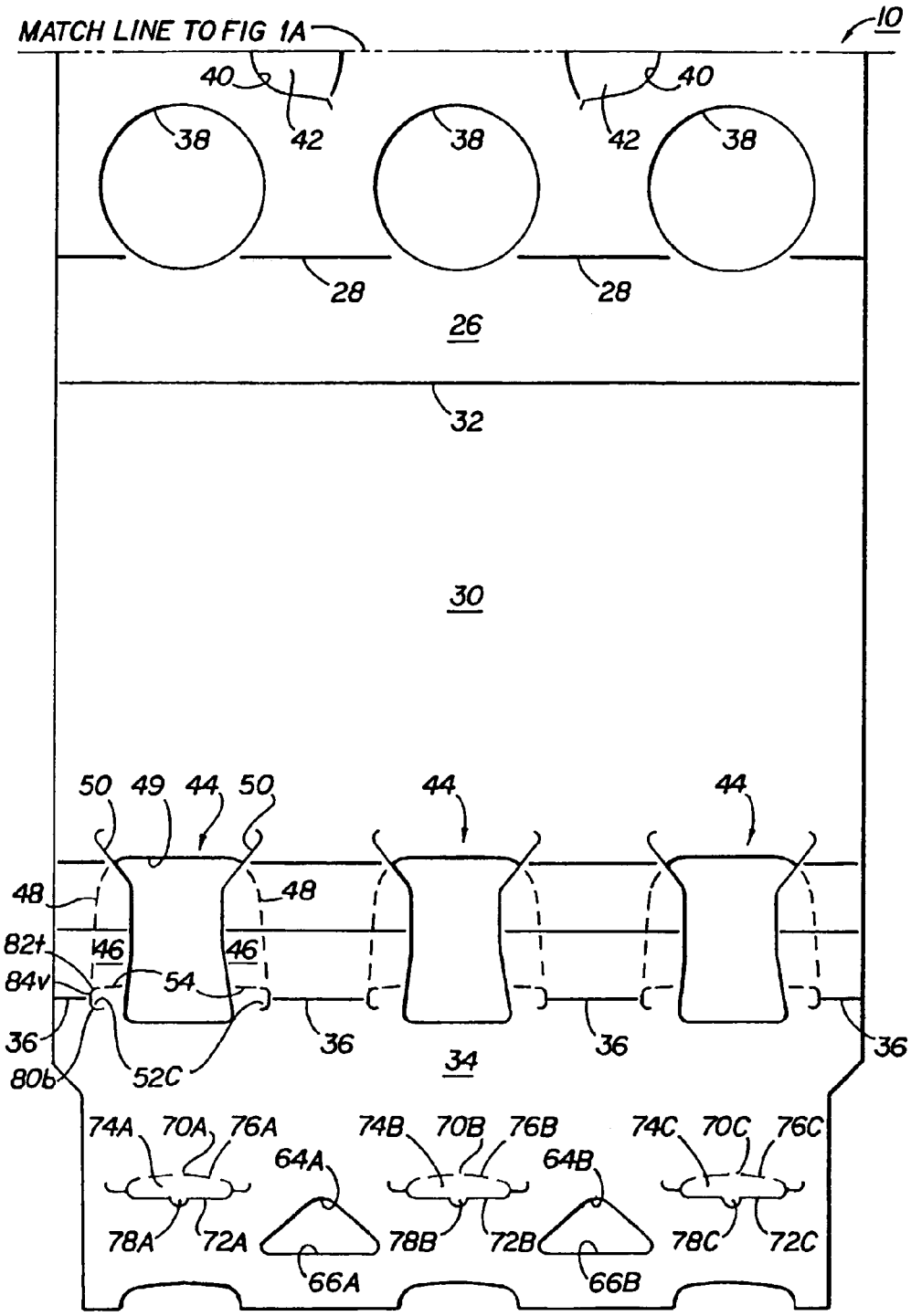

The blank for forming the carrier of this invention with a C cut in the bottom of the hinge for each door in the heel retaining assembly is illustrated in FIGS. 1A and 1B. This blank 10 is designed to contain six beverage bottles B arranged in two rows of three each. The blank 10 is formed from a foldable sheet of material, such as paperboard. The blank 10 has a bottom flap 12, which is foldably connected to a lower side panel 14 by fold line 16, and in turn connected to upper side panel 18 by fold line 20. Upper side panel 18 is connected to top panel 22 by fold line 24, and in turn connected to upper side panel 26 by fold line 28. Upper side panel 26 is connected to lower side panel 30 by fold line 32. Lower side panel 30 is connected to bottom flap 34 by fold line 36.

It will understood by those in the art that the preferable carrier is symmetrical about a horizontal line of bisection, as viewed from FIGS. 1A and 1B. This symmetry aids in the efficient production of the present carrier. The carrier need not have such symmetry, although it is preferred. As shown, the blank 10 is rectangular in shape and includes straight edges, which also makes for an efficient layout of the blank in a web from which the blanks are cut.

The top panel 22 has apertures 38 through which the necks of the bottles B extend. Cuts 40 with flaps 42 can be utilized to provide finger apertures for carrying the carrier.

The heels of the petaloid bottles B may be restrained from movement by the provision of heel retaining assemblies 44. These heel retaining assemblies 44 permit the carrier to be tightly locked in that a portion of the petaloid bottle base can extend through the aperture formed by the heel retaining assembly 44. These heel retaining assemblies 44 are all identical. Each of the assemblies has a pair of small heel doors 46 in the bottom of the lower side panel 14 and 30 that extend into the bottom flap 12 or bottom flap 34 through fold line 16 or 36 respectively. These heel doors 46 open outwardly during the loading of the carrier with bottles along door hinge 48. This permits a toe of the petaloid bottle to project through the heel aperture 49 of the heel retaining assembly 44. An expansion slit 50 may be provided at the top of each door hinge to allow the projection of a toe of the petaloid bottle to project through the heel aperture 49 without tearing the carrier.

Figure 3:
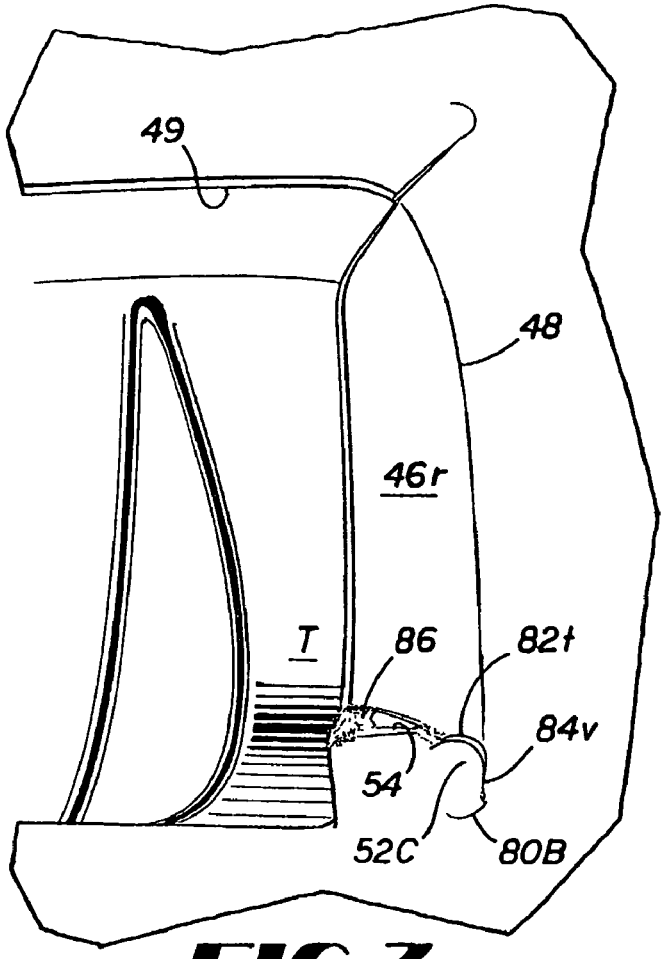
FIG. 3 is a perspective view of one side of the aperture formed by the heel doors where the C cut has been torn through the door because of the misalignment of a toe of the petaloid bottle with the heel aperture.

Each door hinge 48 has a C cut 52C near the bottom of the door hinge with the open portion of the C facing the adjoining heel aperture 49. A tear slit 54 may also be provided between the upper portion of the C 82t and the aperture 49. Fold lines 56 and 58 may be provided to facilitate tightening the carrier about the bottles. If the toe of the petaloid bottle is aligned in the center of heel aperture 49, there should be no tearing of the C cut 52C. However, if the toe is not aligned with the center, but is offside to one side, the C in the hinge line of the door next to that toe may be torn from the top of the C 82*t* through slit 54 to accommodate the bottle so that the carrier can be satisfactorily tightened around the bottles as shown in FIG. 3. The C cuts 52C allow the toe of the bottle to project through heel aperture 49 so that the carrier can be properly tightened.

Figure 2:
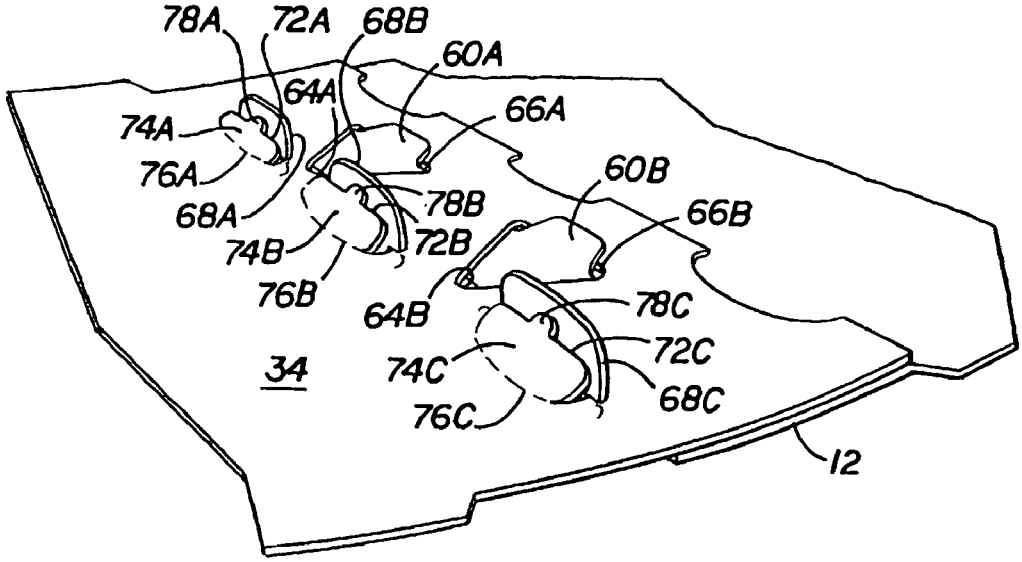
FIG. 2 is a perspective view of the bottom of the wrap around carrier showing the locks in the locked position as viewed from the inside.

The preferred locking system of this invention includes both a primary locking system and a secondary locking system as shown in FIGS. 1A, 1B and 2. The primary locking system is the locking arrangement between primary male locks 60A and 60B formed along fold line 61 in primary lock panel 62 and primary female openings 64A and 64B formed in bottom flap 34. The primary male locks 60A and 60B are hooked over primary female ledges 66A and 66B in locking of the carrier. As it is important to tighten the carrier tightly about the bottle, primary female opening 64A and 64B also serve as tightening apertures, which allow mechanical tightening fingers to enter and tighten the carrier during forming.

The primary locks connect the ends of the carrier together via the flaps, while the secondary locks function to maintain the engaged flaps in place in order to provide a "backup" locking system to prevent the primary locks from separating as shown in FIG. 2.

The secondary locking system consists of secondary male locks 68A–C formed as an extension of bottom flap 12 and secondary female openings 70A–C formed in bottom flap 34. The secondary female openings 70A–C are formed by cut lines 72A–C producing female flaps 74A–C. These flaps can be folded around fold line 76A–C. These flaps have arcuate tabs 78A–C, whose function will be described infra.

While the above described locking system is preferred, it should be understood that the invention can be used with other types of locking systems as well which have similar heel retaining assemblies.

The locking system described above has primary locks that connect the ends of the carrier together and secondary locks that keep the primary locks engaged. The secondary male lock 68A–C is held in the vertical position in respect to the carrier by the secondary female flap 74A–C and the arcuate tab 78A–C on the ends of each flap. If the secondary male lock 68A–C were allowed to be parallel to the bottom panel 12 and bottom flap 34, they could easily become disengaged.

The carrier of this invention is formed from the blank of FIGS. 1A and 1B by moving the top panel 22 of the blank so that a portion of the necks of a group of bottles B extend up through apertures 38. The blank 10 is pulled tight about the bottles B and bottom flap 12 and bottom flap 34 are overlapped with bottom flap 12 being on the outside to form the bottom panel. The primary male locks 60A and 60B are punched inwardly into primary female openings 64A and 64B respectively, and are locked on primary female ledges 66A and 66B.

The secondary male locks 68A–C are pushed inwardly through secondary female openings 70A–C when secondary female flaps 74A–C are pushed inwardly by the secondary male locks 68A–C. Cut lines 72A–C facilitate the insertion of secondary male locks 68A–C into secondary female openings 70A–C.

Secondary male locks 68A–C are held in vertical position by secondary female flaps 74A–C. The secondary female flaps 74A–C fold along fold lines 76A–C. The arcuate tab 78A–C on each secondary female flap 74A–C leans against the secondary male lock 68A–C and assists in holding the secondary male lock 68A–C in the vertical position. Holding the secondary male locks 68A–C in the vertical position ensures that the locks are not accidentally withdrawn. The secondary lock system serves the function of ensuring that the primary lock system does not become undone. The holding of the secondary male locks 68A–C by the secondary female flaps 74A–C and arcuate tabs 78A–C ensures the security of the wrap.

In the process of tightening the carrier around the bottles with a petaloid base, a toe may or may not be centered in heel aperture 49. If a toe is centered in the aperture, the door hinges 48 in conjunction with expansion slits 50 should prevent any tearing of the carrier. However, it is difficult to keep the toes of the petaloid bottles so aligned in the process of wrapping a wrap around carrier about the bottles. If a toe is to one side as shown in FIG. 3, where the toe is offset to the right of the center heel aperture 49, the top of the C on the adjacent heel door 46r may be torn through tear slit 54 to the heel aperture 49 to accommodate the toe T but allow the carrier to be properly tightened about the bottles.

Figure 4:
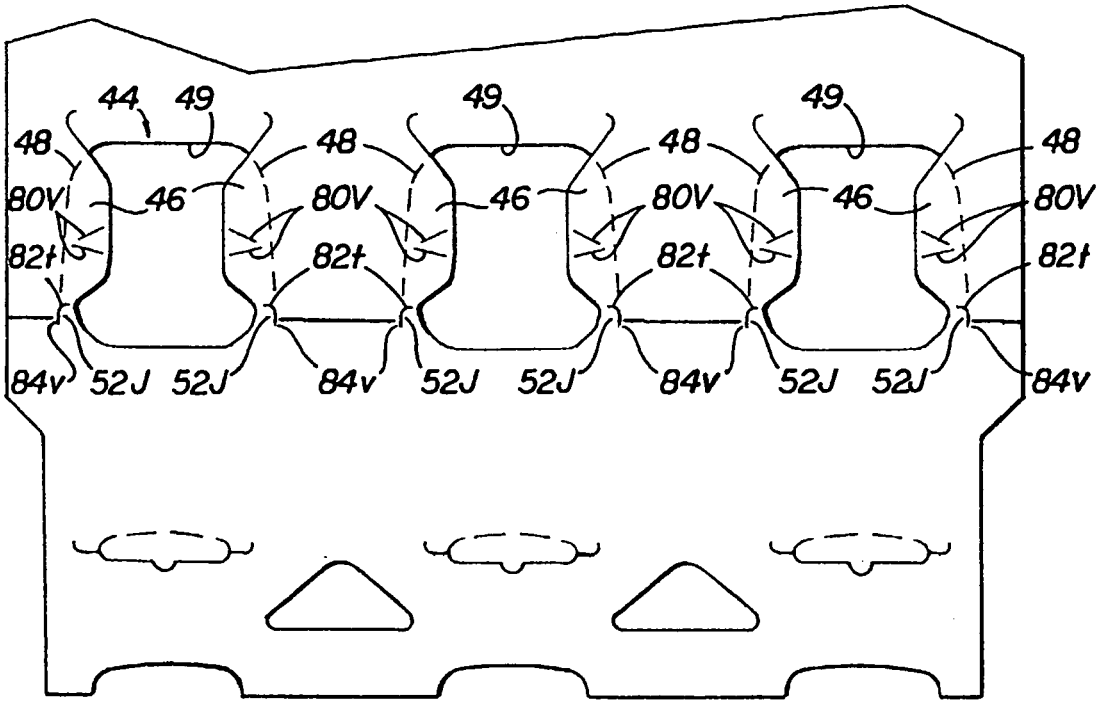
FIG. 4 is a partial plan view of a blank which incorporates the upside down J cut in each door hinge of the present invention.
Figure 5:
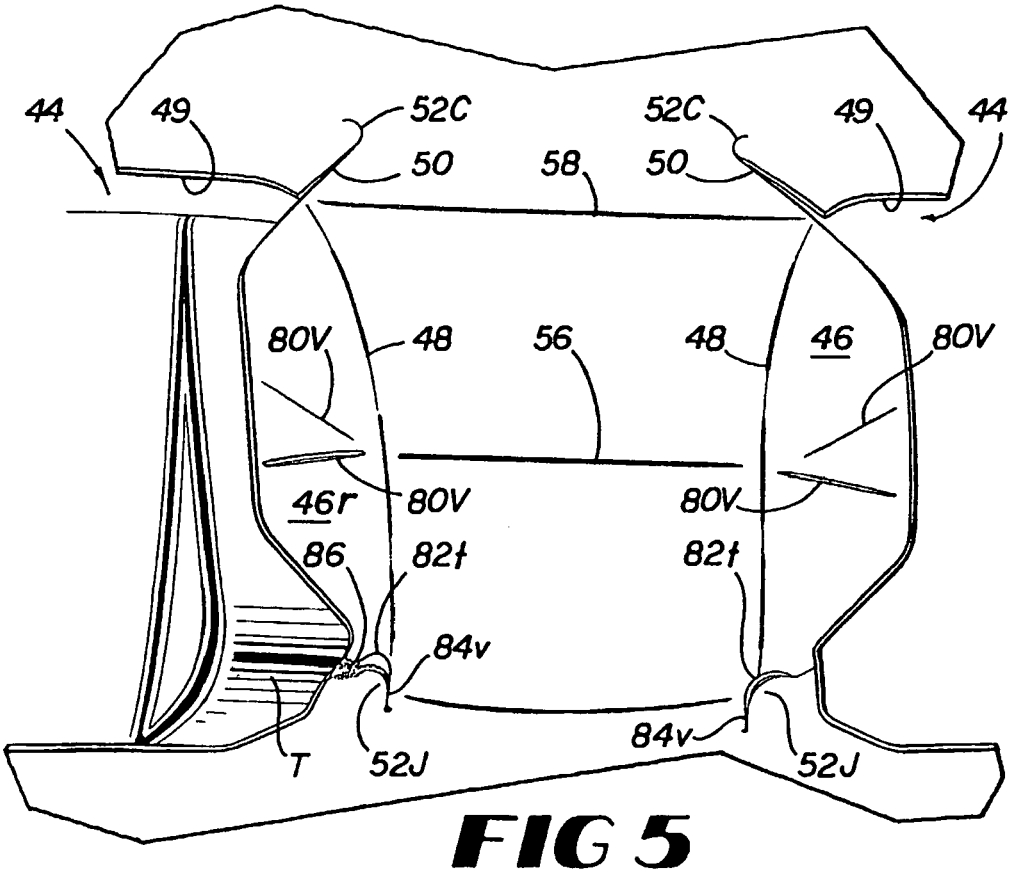
FIG. 5 is perspective view of one of the apertures formed by the opening of the heel doors where the toe of the petaloid bottle is not centered in the aperture and the upside down J cut is torn into the aperture to allow the carrier to be properly tightened.

A blank with upside down J cuts in the door hinge for each door is illustrated in a partial plan view in FIG. 4. This blank is otherwise identical to the blank illustrated in FIGS. 1A and 1B and has identical numbering except as set forth below. It is loaded and wrapped around the bottles in the same way as the blank illustrated in FIGS. 1A and 1B. The blank illustrated in FIG. 4 has an upside down J cut 52J in door hinge 48. The upside down J cut is located near the bottom of door hinge 48 in an upside down position with the top of the J pointing inwardly toward heel aperture 49. The upside down J cut 52J does not need tear slit 54 as required by the blank in FIGS. 1A and 1B. However, it has been found that at least one cut 80V, and preferably two cuts 80V, is necessary near the center of the heel door 46 with the apex of the V pointing towards the adjoining hinge 48. If the toe of the petaloid bottle is centered in heel aperture 49 there should be no tearing of the carrier as expansion slits 50 and door hinges 48 should provide for the necessary expansion. However, if a toe of the petaloid bottle is offset to one side as illustrated in FIG. 5, where its offset towards heel door 46*r*, the bottom of the upside down J may be torn through to heel aperture 49. One can see from FIG. 5 the purpose of the V cuts 80V as they are expanded in width to facilitate the projection of a toe of the petaloid bottle to the right side of the heel aperture 49.

In order to produce a tight wrap, it is necessary for the heel doors 46 to remain intact when a toe T of the petolid bottles B are centered in the heel apertures 49. If the toe T of a bottle is off center in respect to the heel aperture 49, it is necessary to have a controlled tear in the heel door 46 towards which the toe T projects, but only a tear sufficient to accommodate the toe T. Otherwise, a tear may occur that is so great that the carrier cannot be tightened around the bottles. In fact, a tear may occur that destroys the integrity of the carrier resulting in a destroyed package.

It has been found that controlled tear can be made to occur in the heel door 46 towards which an off centered toe T of a petaloid bottle B projects by placing a C cut 52C in the door hinge 48 near the bottom of the hinge as shown in FIG. 1. The C cut 52C has a top cut portion 82*t* that curves inwardly at the top end of C cut 52C towards the heel aperture 49, but stops short of intersecting the heel aperture as shown in FIG. 1A.

In order for this controlled tear to work satisfactorily to produce a tight wrap, it is necessary to have a second cut line that projects inwardly towards the heel aperture from the door hinge. In respect to the C cut 52C this second cut line is located at the bottom of C cut line 52C and is numbered 80*b* as the bottom cut line portion in FIG. 1A. It is necessary that bottom cut line portion 80*b* not connect with heel aperture 49. Thus, C cut line 52C has bottom line cut portion 80*b* that projects towards the heel aperture 49 and also has top line cut portion 82*t* that projects inwardly towards the heel aperture 49. Thus, the C cut line 52 has two inwardly cut lines, one at the bottom 80*b* and one at the top 82*t* of the vertical section 84*v*. This results in a controlled tear 86 developing between heel aperture 49 and cut line 82*t* as shown in FIG. 3. This tear can be facilitated by providing tear slit 54 between top cut line portion 80*t* and the heel aperture 49, but not intersecting either. Thus it will be seen from FIG. 3 that a controlled tear 86 occurs between heel aperture 49 and top cut portion 82*t* when the toe of the petaloid bottle is off centered towards the right hand heel door 46*r* as shown in FIG. 3. The bottom cut portion 80*b* is necessary to relieve the stress imposed by the off centered toe T to prevent excessive tearing of the carrier as illustrated in FIG. 3.

An alternative approach is to use an upside down J cut 52*j* which is constructed utilizing the same stress principles as in constructing the C cut 52C as shown in FIG. 4. The upside down J cut 52*j* has a top cut line portion 82*t* that intersects vertical cut line 84*v* and projects inwardly towards the heel aperture 49. As illustrated in FIG. 4, the provision of at least one cut line 80V that is located near the center of heel door 46 that projects inwardly from door hinge 48 towards heel aperture 49 but does not extend into the door aperture 49 or door hinge, relieves the stress. As illustrated in FIG. 5 two such v cuts 80V may be provided. When the toe T of the petaloid bottle B is off center to the right as illustrated in FIG. 5, a controlled tear 86 occurs between the top cut line portion 82*t* and heel aperture 49. Sufficient stress is relieved by v cut lines 80V to prevent unwanted further tearing of the carrier. This controlled tear 86 is just sufficient to relieve the stress imposed by the off centered toe T, but yet keep the carrier tightly wrapped around the bottles B. FIGS. 4 and 5 clearly illustrate the controlled tear developing between heel aperture 49 and top cut line portion 82*t*. It is shown that this controlled tear 86 does not extend further into the carrier and thus relieves the stress imposed by the off centered toe T of the petaloid bottle, B producing a tight wrap.

While the invention has been disclosed in its preferred forms, it will be apparent to those skilled in the art that many modifications, additions, and deletions can be made therein without departing from the spirit and scope of the invention and its equivalents as set forth in the following claims.

The invention claimed is:

1. A carrier blank, comprising:

a top panel having a plurality of apertures formed therein;

a first side panel foldably connected to said top panel at a first fold line extending across a width of said blank;

a first bottom flap connected to said first side panel;

a second side panel foldably connected to said top panel at a second fold line extending across a width of said blank;

a second bottom flap connected to said second side panel; and a first plurality of heel retaining assemblies formed in said first side panel adjacent to said first bottom flap and a second plurality of heel retaining assemblies formed in said second side panel adjacent to said second bottom flap, each heel retaining assembly comprising:

two doors and a corresponding heel aperture located between said doors, each door being connected to its side panel by a hinge extending generally along a length of said blank, said hinge having top, bottom and center portions, with a C or a J cut disposed at said bottom portion.

2. The carrier blank of claim 1, wherein at least one end of each C or J cut extends inwardly towards its corresponding heel aperture.

3. The carrier blank of claim 2, wherein each C or J cut includes a cut line extending generally along the length of said blank.

4. The carrier blank of claim 2, wherein said first side panel comprises:

a first lower side panel foldably connected to said first bottom flap; and a first upper side panel foldably connected to said first lower side panel and to said top panel.

5. The carrier blank of claim 4, wherein said second side panel comprises:

a second lower side panel foldably connected to said second bottom flap; and a second upper side panel foldably connected to said second lower side panel and to said top panel.

6. The carrier blank of claim 2, wherein said first bottom flap comprises a plurality of male locks, and said second bottom flap comprises a plurality of female openings.

7. The carrier blank of claim 6, wherein said first bottom flap comprises a plurality of secondary male locks formed as an extension of the first bottom flap, and said second bottom flap comprises a plurality of secondary female openings.

8. The carrier blank of claim 2, wherein said plurality of apertures comprises at least four apertures, said first plurality of heel retaining assemblies comprises at least two heel retaining assemblies, and said second plurality of heel retaining assemblies comprises at least two heel retaining assemblies.

9. The carrier blank of claim 2, wherein said C or J cuts are C cuts, said blank further comprising a tear slit extending from each C cut towards its corresponding heel aperture but not connecting said C cut to said heel aperture.

10. The carrier blank of claim 2, wherein said C or J cuts are J cuts, said blank further comprising at least one cut extending between said center portion of each hinge and its corresponding heel aperture.

11. The carrier blank of claim 10, wherein said at least one cut comprises two cuts in a V configuration.

12. A wrap around carrier formed from the carrier blank of claim 1 and at least four petaloid bottles contained therein.

13. A carrier blank, comprising:

a top panel having a plurality of apertures formed therein, a first side panel foldably connected to said top panel;

a first bottom flap connected to said first side panel;

a second side panel foldably connected to said top panel;

a second bottom flap connected to said second side panel; and a first plurality of heel retaining assemblies formed in said first side panel adjacent to said first bottom flap and a second plurality of heel retaining assemblies formed in said second side panel adjacent to said second bottom flap, each heel retaining assembly comprising:

two doors and a corresponding heel aperture located between said doors, each door being connected to its corresponding side panel by a hinge extending generally along a length of said blank, said hinge having top, bottom and center portions, with a cut disposed at said bottom portion, said cut having a first portion extending generally along the length of said blank and at least one end that extends toward its corresponding heel aperture.

14. The carrier blank of claim 13, wherein each cut is a C or J cut.

15. The carrier blank of claim 13, wherein said first side panel comprises:

a first lower side panel foldably connected to said first bottom flap; and a first upper side panel foldably connected to said first lower side panel and to said top panel.

16. The carrier blank of claim 15, wherein said second side panel comprises:

a second lower side panel foldably connected to said second bottom flap; and a second upper side panel foldably connected to said second lower side panel and to said top panel.

17. The carrier blank of claim 13, wherein said first bottom flap comprises a plurality of male locks, and said second bottom flap comprises a plurality of female openings.

18. The carrier blank of claim 17, wherein said first bottom flap comprises a plurality of secondary male locks formed as an extension of the first bottom flap, and said second bottom flap comprises a plurality of secondary female openings.

19. The carrier blank of claim 13, wherein said plurality of apertures comprises at least four apertures, said first plurality of heel retaining assemblies comprises at least two heel retaining assemblies, and said second plurality of heel retaining assemblies comprises at least two heel retaining assemblies.

20. The carrier blank of claim 14, wherein said cuts are C cuts, said blank further comprising a tear slit extending from each C cut towards its corresponding heel aperture but not connecting said C cut to said heel aperture.

21. The carrier blank of claim 14, wherein said cuts are J cuts, the blank further comprising at least one cut extending between said center portion of each hinge and its corresponding heel aperture.

22. The carrier blank of claim 21, wherein the at least one cut comprises two cuts in a V configuration.

23. A wrap around carrier formed from the carrier blank of claim 13 and at least four petaloid bottles contained therein.

24. A carrier blank, comprising:

a top panel having at least four apertures formed therein;

a first side panel foldably connected to said top panel, the first side panel comprising a first lower side panel and a first upper side panel foldably connected to said first lower side panel and to said top panel;

a first bottom flap connected to said first lower side panel and having a plurality of male locks;

a second side panel foldably connected to said top panel, said second side panel comprising a second lower side panel and a second upper side panel foldably connected to said second lower side panel and to said top panel;

a second bottom flap connected to said second lower side panel and having a plurality of female openings; and a first plurality of heel retaining assemblies formed in said first side panel adjacent to said first bottom flap and a second plurality of heel retaining assemblies formed in said second side panel adjacent to said second bottom flap, each heel retaining assembly comprising:

two doors and a corresponding heel aperture located between said doors, each door being connected to its corresponding side panel by a hinge extending generally along a length of said blank, said hinge having top, bottom and center portions, with a cut disposed at said bottom portion, said cut having a first portion extending generally along the length of said blank, and at least one end portion that extends generally along a width of said blank toward its corresponding heel aperture.

25. The carrier blank of claim 24, wherein each cut is a C or J cut.

26. The carrier blank of claim 24, wherein said first bottom flap further comprises a plurality of secondary male locks formed as an extension of the first bottom flap, and said second bottom flap further comprises a plurality of secondary female openings.

27. The carrier blank of claim 24, wherein said plurality of apertures comprises six apertures, said first plurality of heel retaining assemblies comprises three heel retaining assemblies, and said second plurality of heel retaining assemblies comprises three heel retaining assemblies.

28. The carrier blank of claim 24, wherein said cuts are C cuts, said blank further comprising a tear slit extending from each C cut towards its corresponding heel aperture but not connecting said C cut to said heel aperture.

29. The carrier blank of claim 24, wherein said cuts are J cuts, said blank further comprising two cuts in a V configuration extending between said center portion of each hinge and its corresponding heel aperture.

30. A wrap around carrier formed from the carrier blank of claim 24 and at least four petaloid bottles contained therein.

31. A carrier blank, comprising:

a top panel;

a first side panel connected to said top panel;

a second side panel connected to said top panel;

at least one bottom flap; and a plurality of heel retaining assemblies adjacent to said at least one bottom flap, each heel retaining assembly comprising:

two doors and a corresponding heel aperture located between said doors, each door connected to a hinge extending generally along a length of said blank, said hinge having a cut disposed at a bottom portion of the hinge, said cut having a first portion extending generally along the length of said blank and a second portion that extends toward its corresponding heel aperture, wherein each said second portion terminates adjacent to and spaced from an adjacent side of its corresponding heel aperture.

32. The carrier blank of claim 31, wherein each cut is a C or J cut.

33. A carrier blank, comprising:

a top panel;

a first side panel connected to said top panel;

a second side panel connected to said top panel;

at least one bottom flap; and a plurality of heel retaining assemblies adjacent to said at least one bottom flap, each heel retaining assembly comprising:

two doors and a corresponding heel aperture located between said doors, each door connected to a hinge extending generally along a length of said blank, said hinge having a cut disposed at a bottom portion of the hinge, said cut having a first portion extending generally along the length of said blank and a second portion that extends toward its corresponding heel aperture, wherein said cuts are C cuts, said blank further comprising a tear slit extending from each C cut towards its corresponding heel aperture but not connecting said C cut to said heel aperture.

34. The carrier blank of claim 33, wherein each second portion terminates adjacent to an adjacent side of its corresponding heel aperture.

35. A carrier blank, comprising:

a top panel;

a first side panel connected to said top panel;

a second side panel connected to said top panel;

at least one bottom flap; and a plurality of heel retaining assemblies adjacent to said at least one bottom flap, each heal retaining assembly comprising:

two doors and a corresponding heel aperture located between said doors, each door connected to a hinge extending generally along a length of said blank, said hinge having a cut disposed at a bottom portion of the hinge, said cut having a first portion extending generally along the length of said blank and a second portion that extends toward its corresponding heel aperture, wherein said cuts are J cuts, said blank further comprising two cuts in a V configuration extending between a center portion of each hinge and its corresponding heel aperture.

36. The carrier blank of claim 35, wherein each second portion terminates adjacent to an adjacent side of its corresponding heel aperture.

* * * * *